US006081106A

United States Patent [19]

Camerlo

[11] Patent Number: 6,081,106

[45] Date of Patent: Jun. 27, 2000

[54] VOLTAGE SETPOINT ERROR REDUCTION

[75] Inventor: Sergio D. Camerlo, Cupertino, Calif.

[73] Assignee: Cisco Technology, Inc., San Jose, Calif.

[21] Appl. No.: 09/138,583

[22] Filed: Aug. 21, 1998

[51] Int. Cl.[7] ..... G05F 1/44

[52] U.S. Cl. ..... 323/280; 323/281; 323/907

[58] Field of Search ..... 323/273, 274, 323/280, 281, 352, 353, 907; 257/379, 528, 536, 538

[56] References Cited

U.S. PATENT DOCUMENTS

| | | | |
|---|---|---|---|
| 3,728,616 | 4/1973 | Cheek et al. . | |
| 4,161,742 | 7/1979 | Kane . | |
| 4,223,335 | 9/1980 | Kane . | |
| 4,263,518 | 4/1981 | Ballatore . | |
| 4,565,000 | 1/1986 | Brokaw . | |
| 4,769,628 | 9/1988 | Hellerman . | |
| 5,493,148 | 2/1996 | Ohata et al. | 257/538 |
| 5,648,780 | 7/1997 | Neidorff . | |
| 5,877,536 | 3/1999 | Inaba | 257/379 |

OTHER PUBLICATIONS

Linear Technology Datasheet For LT317A, 1990 (no month).

Linear Technology Databook, PUB 1989 by (no month) Linear Technology, Inc., pp. 4–137 to 4–144.

Bourns Datasheet for CAT.CAY Series Arrams, 1995 (no month).

*Primary Examiner*—Jessica Han

*Attorney, Agent, or Firm*—Jay A. Chesavage

[57] ABSTRACT

A precision voltage regulator comprises a three terminal regulator coupled to a voltage divider. The voltage divider has two composite resistors, each of which comprises a plurality of matched value resistors fabricated on a common substrate, mixed in series and parallel configurations. The resultant voltage divider produces a wide range of divider ratios, while preserving a divider ratio which is independent of temperature and tolerance effects.

17 Claims, 2 Drawing Sheets

VOLTAGE SETPOINT ERROR REDUCTION

FIELD OF THE INVENTION

This invention is directed to the class of power supplies having precision output voltages. One particular class of precision output power supplies may further utilize a precision voltage divider in combination with a precision voltage reference for the generation of an error voltage. Different combinations of precision voltage divider ratios may be formed from a single resistor network comprising a plurality of resistors of equal value.

BACKGROUND OF THE INVENTION

Precision power supplies have applications in electronic equipment having narrow tolerance output voltages. It is not uncommon in state of the art electronic equipment to have requirements for output voltage tolerances of less than +/−1%. This disclosure is drawn to the class of such power supplies producing a closely regulated output.

The use of matched resistors as voltage dividers is shown in U.S. Pat. No. 4,161,742 by Cheek et al. This reference shows the use of matched ratio resistors in stepped values combined with a detector for finding cross connections in a wiring harness. The details of fabricating matched resistors in semiconductor devices is discussed in U.S. Pat. No. 4,565,000 by Brokaw. The use of matched resistors for increased accuracy of an A/D converter in U.S. Pat. No. 4,769,628 by Hellerman and in U.S. Pat. No. 5,648,780 by Neidorff.

SUMMARY OF THE INVENTION

The present invention enables a power supply to generate a precision output voltage using a voltage divider formed from a resistor network wherein the individual resistors have the same value, and because they were fabricated on the same substrate in close proximity to each other, are intrinsically closely matched to each other in temperature coefficient. Therefore, a first object of the invention is a power supply having a precision nominal output voltage. A second object of the invention is a power supply having a nominal output voltage which is insensitive to changes in temperature. A third object of the invention is a resistor divider having a precision divider ratio.

DETAILED DESCRIPTION OF THE INVENTION

Figure 1:
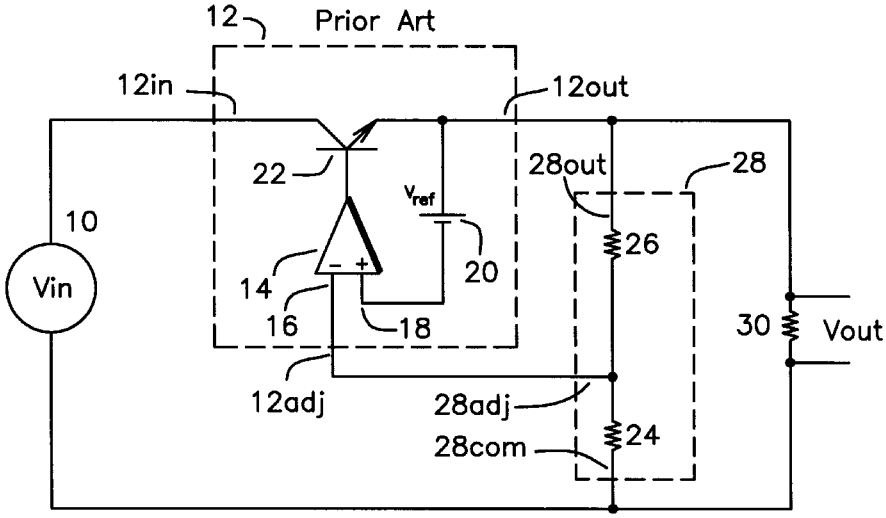
Figure 1 Prior Art
FIG. 1 is the schematic diagram of a prior art power supply.

FIG. 1 shows a prior art voltage regulator, using as an example Linear Technology LT317 adjustable voltage regulator. The essential elements of the power supply are adjustable regulator 12, which has an input 12in, an output 12out, and an adjustment input 12adj. The adjustable regulator output 12out is coupled to the load 30, and a voltage divider 28. The voltage divider 28 has an output terminal 28out, a common terminal 28com, and an adjustment terminal 28adj, which is connected to the adjustable regulator adjustment input 12adj. The adjustable regulator 12 further comprises a pass transistor 22, a precision voltage reference 20, and a precision differential amplifier 14 having an inverting input 16, and a non-inverting input 18. The equations of operation for adjustable regulator 22 are as follows:

$$Vo=V16+Vref$$

where

Vo is the output voltage at terminal 12out

Vref is the reference voltage produced by 20

V16 is the voltage present at terminal 12adj

In practice, the DC gain of amplifier 14 is usually $10^6$, and the input offset voltage of amplifier 14 is less than 2 mV, and precision voltage reference 20 produces 1.250±25 mV. The input bias current to the adjustment pin is 100 uA. Using these values for the Linear Technology LT317A produces the following output equation:

$$Vo = Vref\left(1 + \frac{R_{24}}{R_{26}}\right) + (I_{12adj})R_{24}$$

Figure 2:
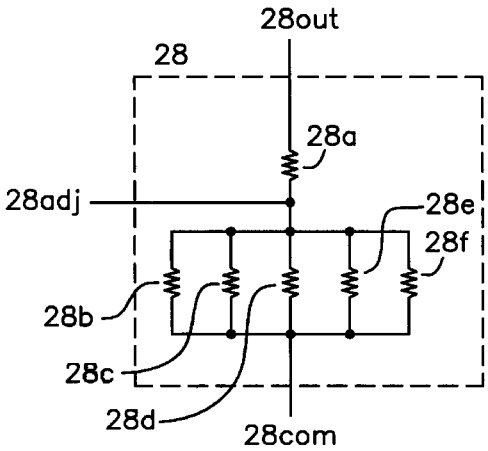
FIG. 2 is the schematic diagram of a voltage divider formed from a resistor network.

FIG. 2 shows the details of the voltage divider. Resistor network 28 is a 6 resistor network where each resistor has the same value. An example of this network is part number CAT16-103-J4, manufactured by Bourns Inc. This is a thick film metallized resistor fabricated by depositing a thin film of metal or a resistive material on a ceramic substrate. Because the individual resistors 28*a, b, c, d, e*, and *f* are in close proximity to each other and share the same resistance coefficient for temperature, the individual resistors tend to have the same value of resistance both in nominal value, as well as with tracking of temperature.

FIG. 2 shows resistors 28*b* through 28*f* connected in parallel, which produces a composite resistor 24 equal to R28/5. The divider coefficient from 28out to 28adj is then 1/1.2=0.833333. In general, given n resistors in a package, one of which is used for resistor 28*a*, and n−1 are in parallel for resistors 28*b,c*, and so on, the divider ratio is 1/n. So for the example of FIG. 2, n=6, and the divider ratio is 1/6. For the same case where 2 resistors are placed in parallel for 28*a*, and the remainder n−2 of the resistors are in parallel for resistor 24, as in FIG. 4, the divider ratio is 2/n. In the general case of a resistor network having n resistors, m in parallel to form resistor 26 and n-m in parallel to form resistor 24, the divider ratio is m/n. Thus, any divider ratio of m/n may be generated using a resistor pack having n resistors. A sensitivity analysis of the resistor sensitivities shows that if temperature causes the resistor pack to increase in temperature by some temperature ΔT, and the resistor pack has a temperature coefficient of 200 ppm per degree Celcius, the change in resistance of $\Delta T*200*10^{-6}$ is applied to each of m and n of the above ratio. Hence, the fractional increase in effective resistance of the ratio m/n does not change, and the divider ratio stays fixed despite the increased resistance of each of m and n.

Figure 3:
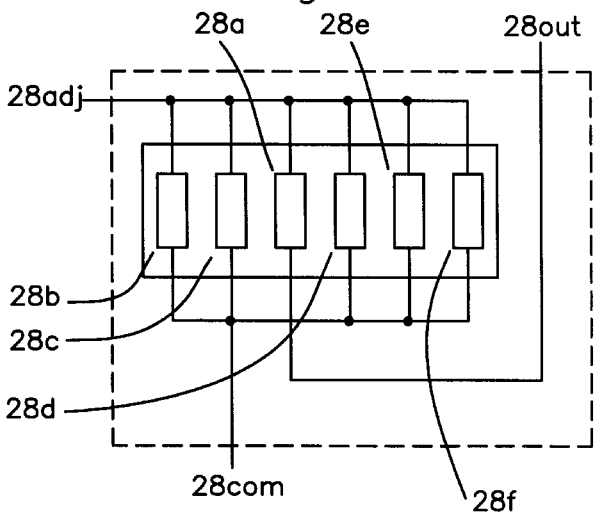
FIG. 3 is the top view of the voltage divider network of FIG. 2.

FIG. 3 shows the top view of a resistor pack wired as shown in the schematic of FIG. 2. Connections are made to resistor 28*a* in the middle to better thermally couple resistor 28*a* to the surrounding resistors 28*b–f*. Terminals 28adj, 28out, and 28com are shown corresponding to the matching terminals of the same name in FIG. 2.

Figure 4:
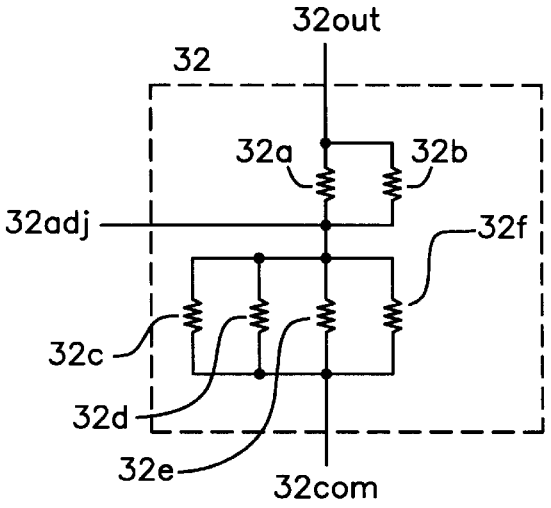
FIG. 4 is the schematic diagram of a voltage divider formed from a parallel network.

FIG. 4 shows an alternative embodiment of the voltage divider 28, shown in the figure as divider 32, having individual resistors 32*a–e* formed from the network. Resistors 32*a* and 32*b* are placed in parallel in this embodiment.

Figure 5:
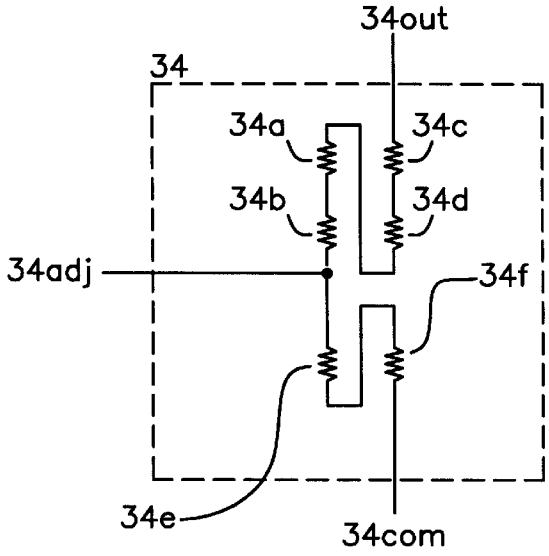
FIG. 5 is the schematic diagram of a voltage divider formed from a series network.

FIG. 5 shows another alternative embodiment of the voltage divider 28, shown in the figure as divider 34, having individual resistors placed in series.

Figure 6:
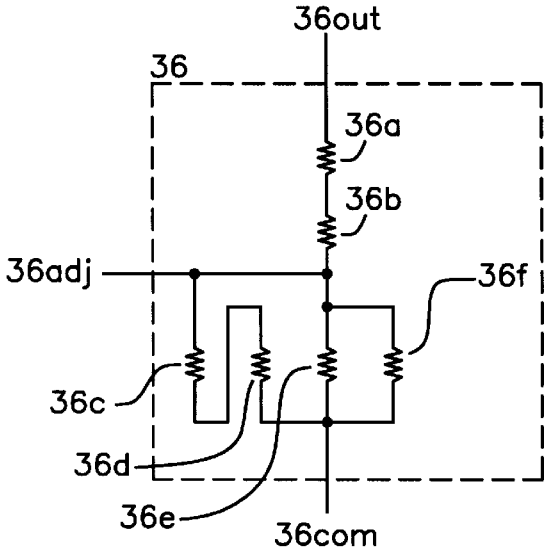
FIG. 6 is the schematic diagram of a voltage divider formed from a combination of series and parallel networks.

FIG. 6 shows another alternative embodiment of the voltage divider 28, shown in the figure as divider 36, wherein the resistance is further trimmed by the series combination 36*c* and 36*d*, which are in parallel to resistors 36*e* and 36*f*.

Careful selection topology configurations of matched resistors forming resistor 24 and 26 of FIG. 1 will yield many precision divider ratio values. It should be clear to one skilled in the art that while the foregoing invention specifies for examplar purposes resistor networks comprising 6 resistors, the invention clearly scales to n resistors without limit. Similarly, not all combinations of series and parallel resistor topologies are described in FIGS. 2–6. Nevertheless, it is clear to one skilled in the art that there is no limitation to the combinations of resistor networks that can be made using series and parallel networks, including the use of resistors which span the three nodes "out", "adj", and "com" of divider 28 in arbitrary ways.

I claim:

1. A precision power supply having an input terminal, an output terminal, and a common terminal, said power supply comprising:

an adjustable regulator having a voltage input coupled to said power supply input terminal, a voltage output coupled to said power supply output terminal, and an adjustment input, said adjustable regulator producing an output terminal voltage equal to said adjustment input voltage added to a reference voltage, a voltage divider having a divider output coupled to said power supply output terminal, a divider common coupled to said power supply common terminal, and a divider adjustment output coupled to said adjustable regulator adjustment input;

said voltage divider comprising a plurality n of individual resistors of equal values fabricated on a common substrate having a center wherein n/2 resistors are on one side of said center, and n/2 resistors are on the other side of said center, m of said resistors connected in parallel to form a first resistor connected between said voltage divider output and said voltage divider adjustment output, n-m of said resistors connected in parallel to form a second resistor connected between said voltage divider adjustment output and said divider commons;

said m first resistors and said n-m second resistors distributed equally on each side of said center and thermally coupled to each other such that thermal gradients across the area of said m first resistors and said n-m second resistors have minimum effect on the divider ratio formed by dividing said divider adjustment output by said divider output, wherein said n is an integer larger than said m.

2. The regulator of claim 1 where said adjustable regulator is a monolithic integrated circuit.

3. The regulator of claim 2 wherein said reference voltage comprises a bandgap voltage reference.

4. The regulator of claim 3 where said resistor divider comprises a thick film resistor network.

5. The regulator of claims 1, 2, 3, or 4 wherein said m resistors are interleaved with said n-m resistors.

6. A precision power supply having an input terminal, an output terminal, and a common terminal, said power supply comprising:

an adjustable regulator having a voltage input coupled to said power supply input terminal, a voltage output coupled to said power supply output terminal, and an adjustment input, said adjustable regulator producing an output terminal voltage equal to said adjustment input voltage added to a reference voltage, a voltage divider having a divider output coupled to said power supply output terminal, a divider common coupled to said power supply common terminal, and a divider adjustment output coupled to said adjustable regulator adjustment input;

said voltage divider comprising a plurality n of individual resistors of equal values fabricated on a common substrate having a center wherein n/2 resistors are on one side of said center, and n/2 resistors are on the other side of said center, m of said resistors connected in series to form a first resistor connected between said voltage divider output and said voltage divider adjustment output, n-m of said resistors connected in series to form a second resistor connected between said voltage divider adjustment output and said divider common, said m first resistors and said n-m second resistors distributed equally on each side of said center and thermally coupled to each other such that thermal gradients across the area of said m first resistors and said n-m second resistors have minimum effect on the ratio formed by dividing said divider adjustment output by said voltage divider output, wherein said n is an integer larger than said m.

7. The regulator of claim 6 where said adjustable regulator is a monolithic integrated circuit.

8. The regulator of claim 7 wherein said reference voltage comprises a bandgap voltage reference.

9. The regulator of claim 8 where said resistor divider comprises a thick film resistor network.

10. The regulator of claims 6, 7, 8, or 9 wherein said m resistors are interleaved with said n-m resistors.

11. A precision power supply having an input terminal, an output terminal, and a common terminal, said power supply comprising:

an adjustable regulator having a voltage input coupled to said power supply input terminal, a voltage output coupled to said power supply output terminal, and an adjustment input, said adjustable regulator producing an output terminal voltage equal to said adjustment input voltage added to a reference voltage, a voltage divider having a divider output coupled to said power supply output terminal, a divider common coupled to said power supply common terminal, and a divider adjustment output coupled to said adjustable regulator adjustment input;

said voltage divider comprising a plurality n of individual resistors of equal values fabricated on a common substrate having a center wherein n/2 resistors are on one side of said center, and n/2 resistors are on the other side of said center, m of said resistors connected in a combination of parallel and series to form a first resistor connected between said voltage divider output and said voltage divider adjustment output, n-m of said resistors connected in a combination of parallel and series to form a second resistor connected between said voltage adjustment output and said divider common, said m first resistors and said n-m second resistors distributed equally on each side of said center and thermally coupled to each other such that thermal gradients across the area of said m first resistors and said n-m second resistors have minimum effect on the ratio formed by dividing said divider adjustment output by said voltage divider output, wherein said n is an integer larger than said m.

12. The regulator of claim 11 where said adjustable regulator is a monolithic integrated circuit.

13. The regulator of claim 12 wherein said reference voltage comprises a bandgap voltage reference.

14. The regulator of claim 13 where said resistor divider comprises a thick film resistor network.

15. The regulator of claims 11, 12, 13, or 14 wherein said m resistors are interleaved with said n-m resistors.

16. A voltage divider having an input, an output, and a common, said voltage divider having a first resistor connected between said input and said output, and a second resistor connected between said output and said common, said first and second resistors comprising a plurality n of individual resistors of equal values fabricated on a common substrate having a center wherein n/2 resistors are on one side of said center, and n/2 resistors are on the other side of said center, m of said resistors connected in parallel to form said first resistor, n-m of said resistors connected in parallel to form said second resistor, said m first resistors and said n-m second resistors distributed equally on each side of said center and thermally coupled to each other such that thermal gradients across the area of said m first resistors and said n-m second resistors have minimum effect on the ratio formed by dividing said divider adjustment output by said voltage divider output, wherein said n is an integer larger than said m.

17. A voltage divider having an input, an output, and a common, said voltage divider having a first resistor connected between said input and said output, and a second resistor connected between said output and said common, said first and second resistors comprising a plurality n of individual resistors of equal values fabricated on a common substrate having a center wherein n/2 resistors are on one side of said center, and n/2 resistors are on the other side of said center, m of said resistors connected in series or parallel combinations to form said first resistor, n-m of said resistors connected in series or parallel combinations to form said second resistor, said m first resistors and said n-m second resistors distributed equally on each side of said center and thermally coupled to each other such that thermal gradients across the area of said m first resistors and said n-m second resistors have minimum effect on the ratio formed by dividing said divider adjustment output by said voltage divider output, wherein said n is an integer larger than said m.

* * * * *